US005144766A

United States Patent [19]

Hashish et al.

[11] Patent Number: 5,144,766

[45] Date of Patent: Sep. 8, 1992

[54] LIQUID ABRASIVE CUTTING JET CARTRIDGE AND METHOD

[75] Inventors: Mohamed A. Hashish, Kent; John H. Olsen, Vashon Island; Katherine J. Zarin, Kent; Glenn A. Erichsen, Everett, all of Wash.

[73] Assignee: Flow International Corporation, Kent, Wash.

[21] Appl. No.: 841,717

[22] Filed: Feb. 26, 1992

Related U.S. Application Data

[63] Continuation of Ser. No. 431,617, Nov. 3, 1989, Pat. No. 5,092,085.

[51] Int. Cl.[5] ..... B24C 5/04

[52] U.S. Cl. ..... 51/439; 51/410

[58] Field of Search ..... 51/410, 411, 439; 239/434, 597, 601

[56] References Cited

U.S. PATENT DOCUMENTS 4,648,215 3/1987 Hashish et al. ..... 51/439
4,711,056 12/1987 Herrington et al. ..... 51/439 X
4,817,874 4/1989 Jarzebowicz ..... 51/439 X
4,848,671 7/1989 Saurwein ..... 51/439 X
4,872,615 10/1989 Myers ..... 51/439 X

FOREIGN PATENT DOCUMENTS 601515 2/1960 Italy ..... 51/439

*Primary Examiner*—James G. Smith
*Attorney, Agent, or Firm*—Hughes & Multer

[57] ABSTRACT

A high pressure liquid jet abrasive cutting apparatus having a removable and replaceable cartridge assembly. This cartridge assembly has a nozzle unit with a jewel orifice, an intermediate mixing chamber where the liquid jet and the abrasive particles mix, and a discharge tube through which the liquid jet incorporating abrasive particles therein is discharged. The nozzle unit and the discharge tube are preassembled in a cartridge housing at a factory location under controlled conditions, so that precise alignment is obtained. Replacement of the worn parts is accomplished by interchange of the cartridge assembly.

4 Claims, 6 Drawing Sheets

LIQUID ABRASIVE CUTTING JET CARTRIDGE AND METHOD

This is a continuation of application Ser. No. 431,617, filed Nov. 3, 1989, now U.S. Pat. No. 5,092,085.

FIELD OF THE INVENTION

The present invention relates to liquid jet cutting where a liquid is brought to a very high pressure and then discharged as a high velocity jet for cutting and/or erosion operations, and more particularly to an apparatus and method which incorporates abrasive particles in the jet.

BACKGROUND ART

High velocity liquid jets have been used for a number of years to accomplish various industrial applications, such as cutting or cleaning. Typically, a liquid (generally water) is brought to a very high pressure (e.g. 10,000 to 100,000 PSI, or possibly higher) and then discharged through a small orifice to form a high velocity jet (e.g. having a diameter at the exit plane of the nozzle of between about 0.003 to 0.050 inch, and with velocities in the order of 1000 to 3000 feet per second, or possibly higher).

It has also been known for a number of years that the cutting or erosive action can be improved, particularly in connection with hard materials, such as metal, if abrasive particles are incorporated in the liquid jet. Such a system is disclosed in U.S. Pat. No. 4,648,215 (Hashish et al). In that patent, there is disclosed an apparatus where liquid is brought to a very high pressure in a chamber and is discharged through a jewel orifice to form a high velocity jet that is directed into a mixing chamber. Abrasive particles (e.g. garnet, silica sand, aluminum oxide, having a particle size of 50 to 500 microns) are directed into the mixing chamber through a laterally extending passageway, with the abrasive particles being incorporated in the liquid jet. Then the liquid jet, with the abrasive particles, is directed into a converging inlet of an elongate passageway defined by a tube. The liquid jet, then exits from the tube as a liquid/abrasive jet which can be used for various industrial operations, such as cutting or abrading.

In the particular arrangement shown in U.S. Pat. No. 4,648,215, the discharge tube 46 is held in its operating position by means of a compression fitting sleeve 49 which in turn is held in place by a compression nut 48. The jewel orifice 37 is mounted to a jewel holder 36 which in turn is centered on a nozzle body or housing 32.

With the abrasive ladened liquid passing through the discharge tube at a high velocity, this discharge tube, even though being made of a highly wear-resistant material, experiences wear along the interior cylindrical surface that defines the passageway. Accordingly, this discharge tube must be replaced periodically within a time of possibly as short as a half hour, or perhaps as high as 40 hours, depending upon the material used and other factors. Also, the jewel orifice, even though being made of a hard material (e.g. sapphire) is also subject to wear, and this must be replaced periodically. Further, since the overall jet cutting apparatus is considerably more durable than both the discharge tube and the orifice, the usual practice has been to make both the jewel orifice and the discharge nozzle readily accessible so that these can be replaced periodically.

It has also then found that it is necessary to align the waterjet inside the mixing tube such that the waterjet coincides with the mixing tube center line as much as possible. The jewel orifice and the discharge tube need to be assembled within quite close tolerances to avoid premature wear and to enhance proper operation. For this reason, various arrangements have been used in the prior art to enable the replacement parts to be mounted in reasonably close alignment. One method of accomplishing this is shown in U.S. Pat. No. 4,817,874, where the discharge tube that is located downstream of the orifice is mounted in a manner so that it can be adjusted pivotally about a center point corresponding to the location of the orifice.

To the best knowledge of the applicants herein, the prevalent philosophy in the industry has been directed toward (a) convenient access to both the jewel orifice and the discharge tube, (b) easy replacement of these components, and (c) means for adjusting the components into reasonably close alignment. Even so, it has been recognized in the industry that the "down time" involved in such replacement and alignment is a significant cost factor. Also, the people who accomplish the replacement and alignment of these components must have a certain degree of skill in accomplishing these tasks. Further, there is a consideration that these design objectives must be accomplished in an environment where extremely high liquid pressures are involved, and this imposes other design constraints, one of these being that there must be proper sealing provisions to contain this very high pressure liquid (e.g. water) and properly direct it to the jewel orifice. Further, this must be accomplished in a manner that the abrasive particles are properly directed into the mixing chamber through which the water jet travels to pass into the discharge tube.

SUMMARY OF THE INVENTION

The present invention represents a significant departure from the prevalent philosophy of accomplishing the convenient replacement of the more rapidly wearing components of liquid/abrasive jet cutting apparatus, along with the necessary adjustment for proper alignment. In the present invention, there is provided a unitized, structurally rigid cartridge assembly adapted to be removably mounted as a unit to a main housing structure in an operating position in a manner to receive high pressure liquid from a high pressure liquid chamber in said housing structure.

This cartridge assembly comprises an integrally rigid cartridge housing having an upstream inlet location and a downstream discharge location. This cartridge housing defines an intermediate mixing chamber positioned between the upstream and downstream locations, and has an abrasive inlet opening means adapted to receive abrasive particles and direct these particles into the mixing chamber.

There is a nozzle means (preferably comprising a jewel orifice) fixedly positioned in the cartridge housing at the upstream inlet location.

The cartridge housing further comprises a liquid/abrasive outlet opening means which is aligned with the jet inlet opening and the mixing chamber. A liquid abrasive discharge tube means is fixedly positioned at the liquid/abrasive outlet opening means, with this tube defining an elongate discharge passageway which has an accurately positioned and aligned discharge passageway axis aligned with a longitudinal axis of the cartridge assembly. This tube receives and contains the jet with the abrasive therein from the mixing chamber and discharges the jet with the abrasive as an abrasive ladened jet.

The discharge passageway axis of the discharge tube is accurately positioned and aligned with the nozzle means, and the nozzle means is positioned so that the liquid jet which is discharged therefrom travels in accurate alignment along the center axis and along the discharge passageway axis, within a tolerance of about one quarter of the diameter of the tube from the centerine of the tube.

Further, the apparatus is arranged so that there is a high pressure liquid seal means between the main housing structure and the cartridge assembly relative to liquid flow from the high pressure chamber through the nozzle means. The apparatus is provided with connecting means by which the cartridge assembly as a unit can be removably mounted in its operating position to the main housing structure.

Thus, the cartridge assembly can be manufactured and assembled under controlled factory conditions so that suitable manufacturing techniques can be utilized to provide the accurate positioning and alignment of the jet discharged from the nozzle means and the discharge tube and then fixedly position these components in the cartridge housing. Since the cartridge housing is a integrally rigid member, and since the positioning and alignment of the nozzle means and the discharge tube is fixed, this relative positioning and alignment remains constant when the cartridge is inserted in its operating position and removed therefrom. Since the sealing means and the disconnect means provide proper operating engagement between the cartridge assembly and the main housing, proper operation is provided.

In a first embodiment of the present invention, the connecting means is provided in the form of a retaining nut which is threaded onto the main housing, with the main housing forming with an upper surface of the cartridge housing a seal, such as a metal to metal seal. An abrasive particle housing which provides an infeed passageway for the abrasive particles is then mounted to the cartridge housing.

In a second embodiment, the cartridge is moved laterally into a recess formed in the main housing, and the upper portion of the cartridge housing forms a seal with the main housing, this being conveniently provided in the form of a quick disconnect seal. The quick disconnect seal assembly can be positioned either in the cartridge housing or in the main housing.

In the method of the present invention, the components of the cartridge assembly is provided as above, and the nozzle means and the discharge tube are placed in proper alignment in the cartridge housing. One method of doing this is to preassemble the components with the orifice or opening not yet formed in the nozzle means, and with the discharge tube fixedly mounted. Then the opening is formed in the nozzle means, using the centerline of the discharge tube as a reference for alignment.

A second method of fabricating the cartridge assembly within proper alignment tolerances is to set the nozzle assembly in place in the cartridge housing, and then to align the tube with the nozzle means. This can be accomplished by emitting a liquid jet through the nozzle means, aligning the tube with the liquid jet, and then fixing the tube in place. Alternatively, a laser could be used for alignment.

A third method of accomplishing alignment would be a statistical method by which the cartridge assemblies are assembled within reasonably close tolerances, and these are tested in the same manner as described in the above paragraph (i.e. by emitting a liquid jet through the nozzle assembly). Those assemblies which do not have accurate alignment are simply randomly reassembled, and these are tested again. In this manner, properly aligned cartridge assemblies are provided, and the remaining few which after one or more reassemblies cannot be properly aligned are simply discarded.

Other features will become apparent from the following detailed description.

DESCRIPTION OF THE PREFERRED EMBODIMENT

Figure 1:
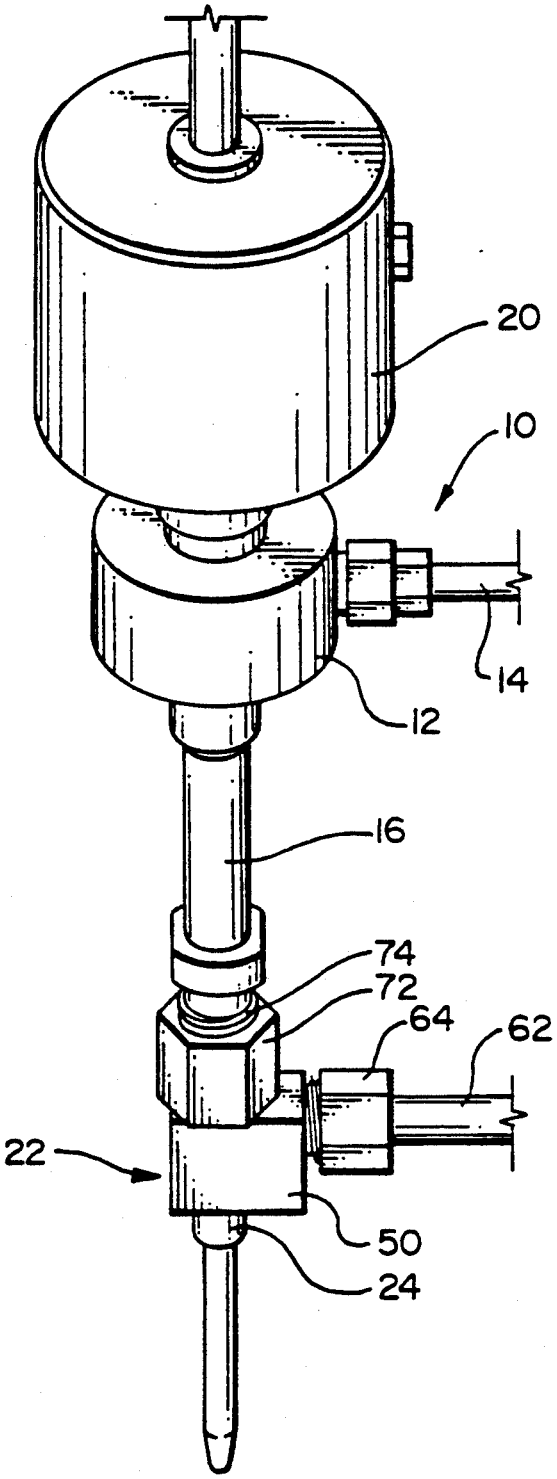
FIG. 1 is an isometric view of a liquid jet cutting apparatus incorporating a first embodiment of the present invention.
Figure 2:
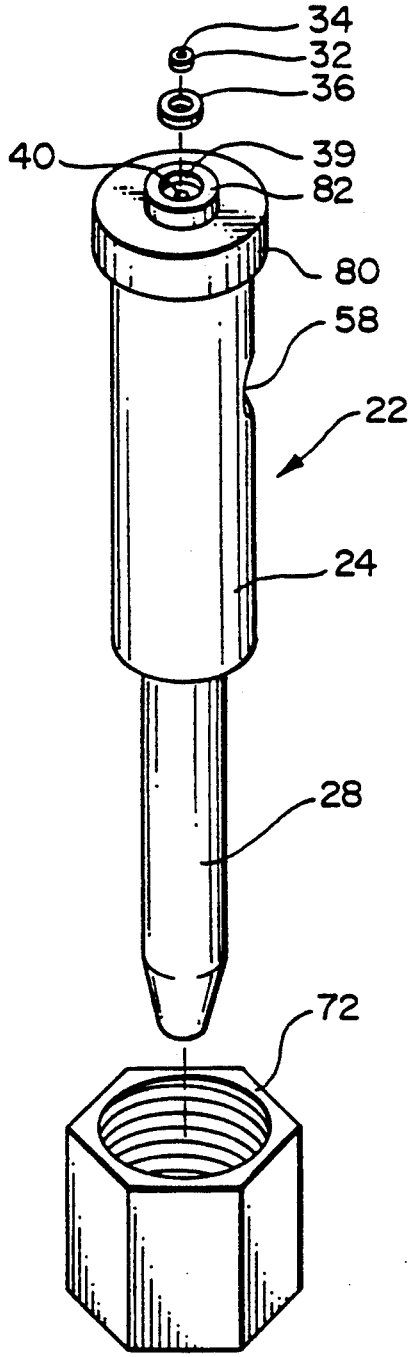
FIG. 2 is an isometric view of the cartridge assembly of the first embodiment, with the orifice element and orifice mounting member shown removed from the rest of the cartridge assembly, and also showing a retaining nut.

With reference to FIG. 1, the liquid/abrasive jet cutting apparatus 10 of the first embodiment comprises a valve member 12 which receives high pressure water through a conduit 14 and delivers this high pressure water into a main housing 16 which defines a high pressure water chamber 18. There is an air actuated valve control device 20 which operates the valve member 12 to control flow from the line 14 into the chamber 18 of the main housing 16. These components 12 through 20 are or may be components which are already well known in the prior art.

Figure 3:
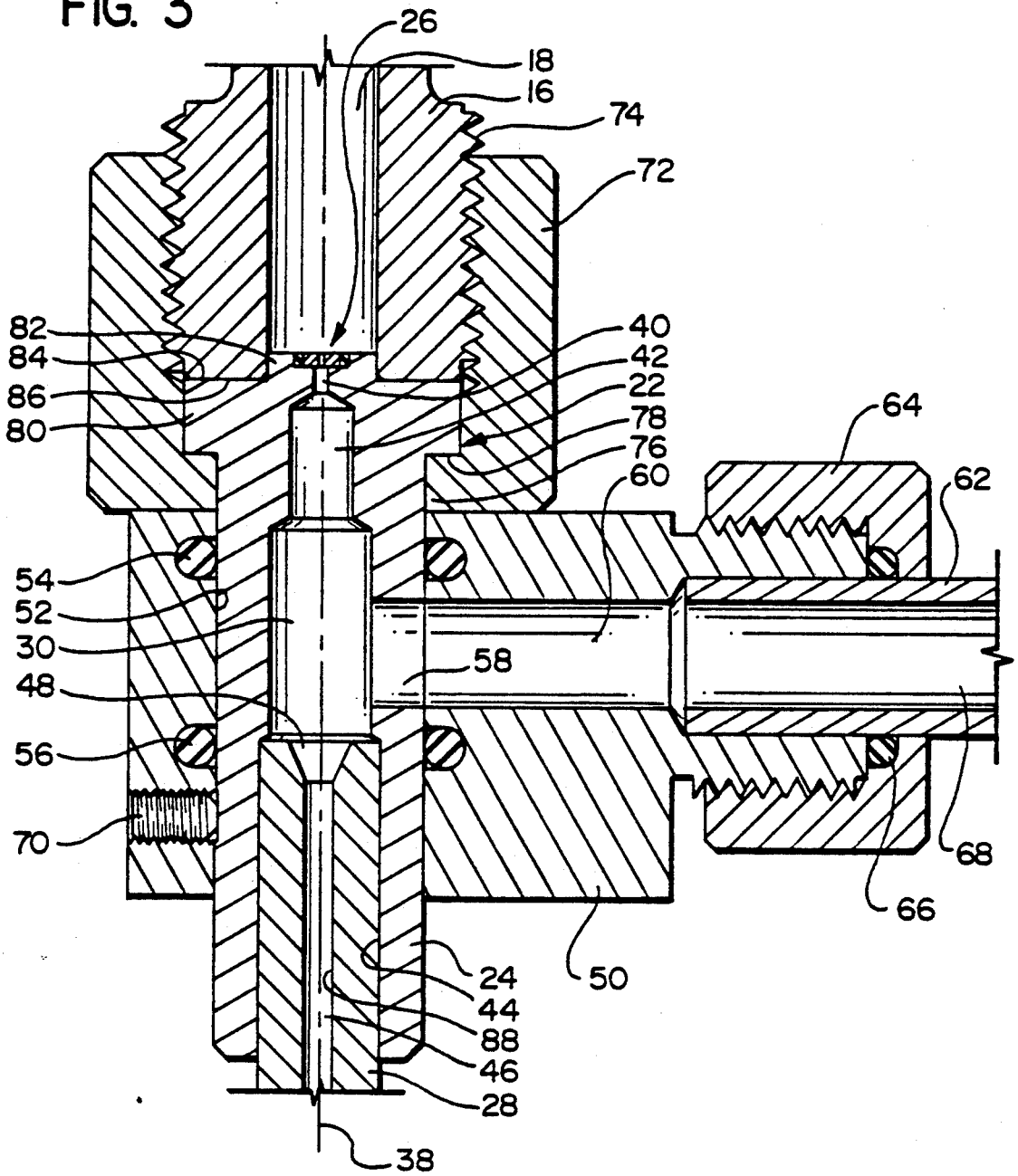
FIG. 3 is a sectional view taken along the longitudinal centerline of the cartridge assembly, and also showing the abrasive feed attachment for the assembly.
Figure 3A:
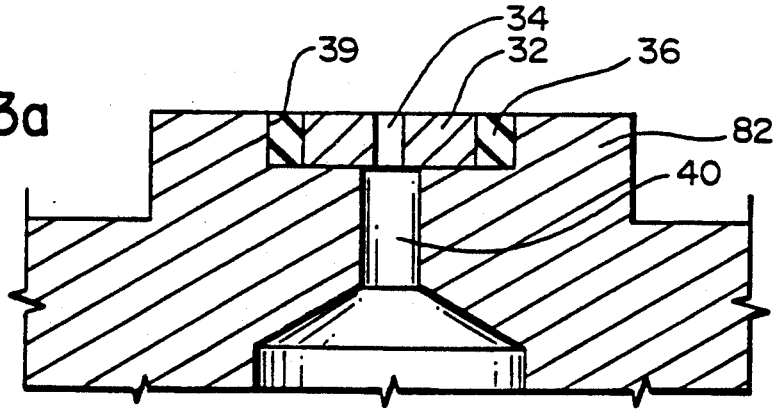
FIG. 3*a* is an enlarged cross sectional view showing the nozzle means.
Figure 4:
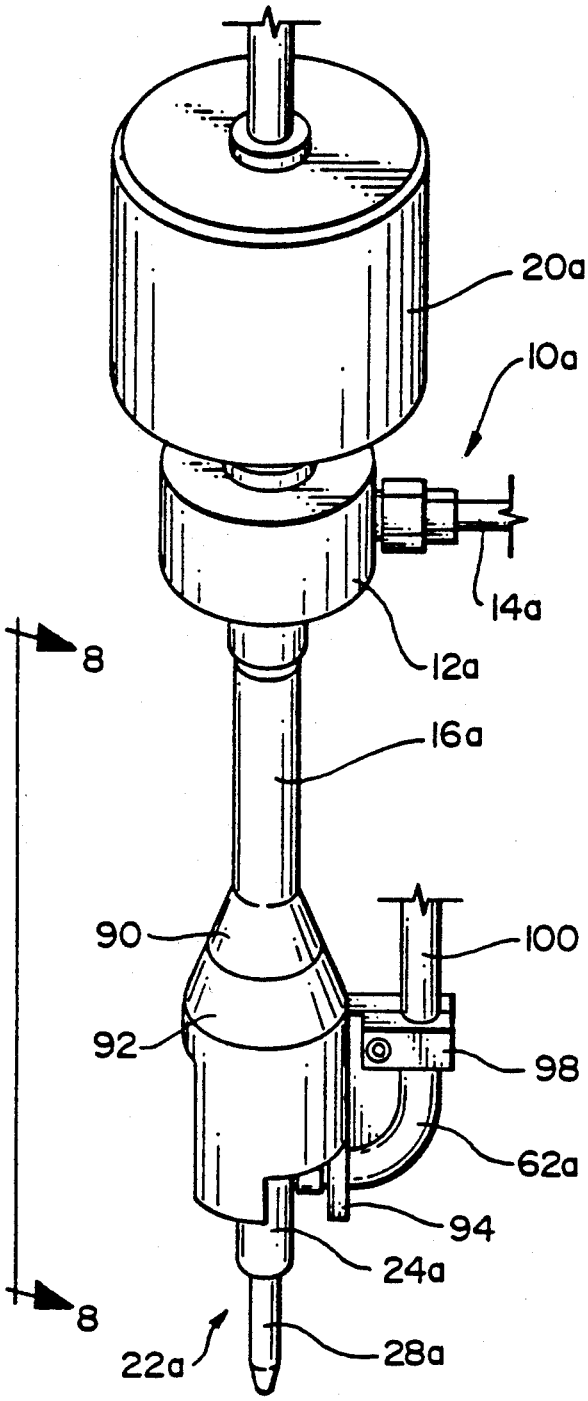
FIG. 4 is an isometric view of a liquid jet cutting apparatus incorporating a second embodiment of the present invention.
Figure 5:
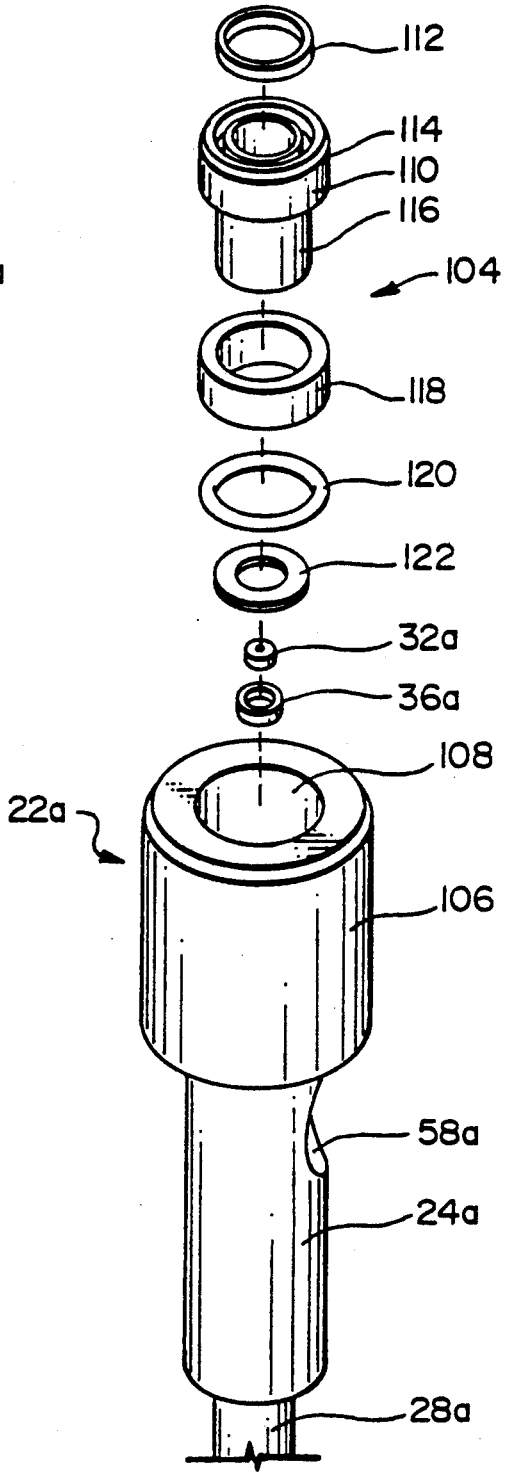
FIG. 5 is an exploded isometric view showing the various components of the cartridge assembly of the second embodiment.
Figure 6:
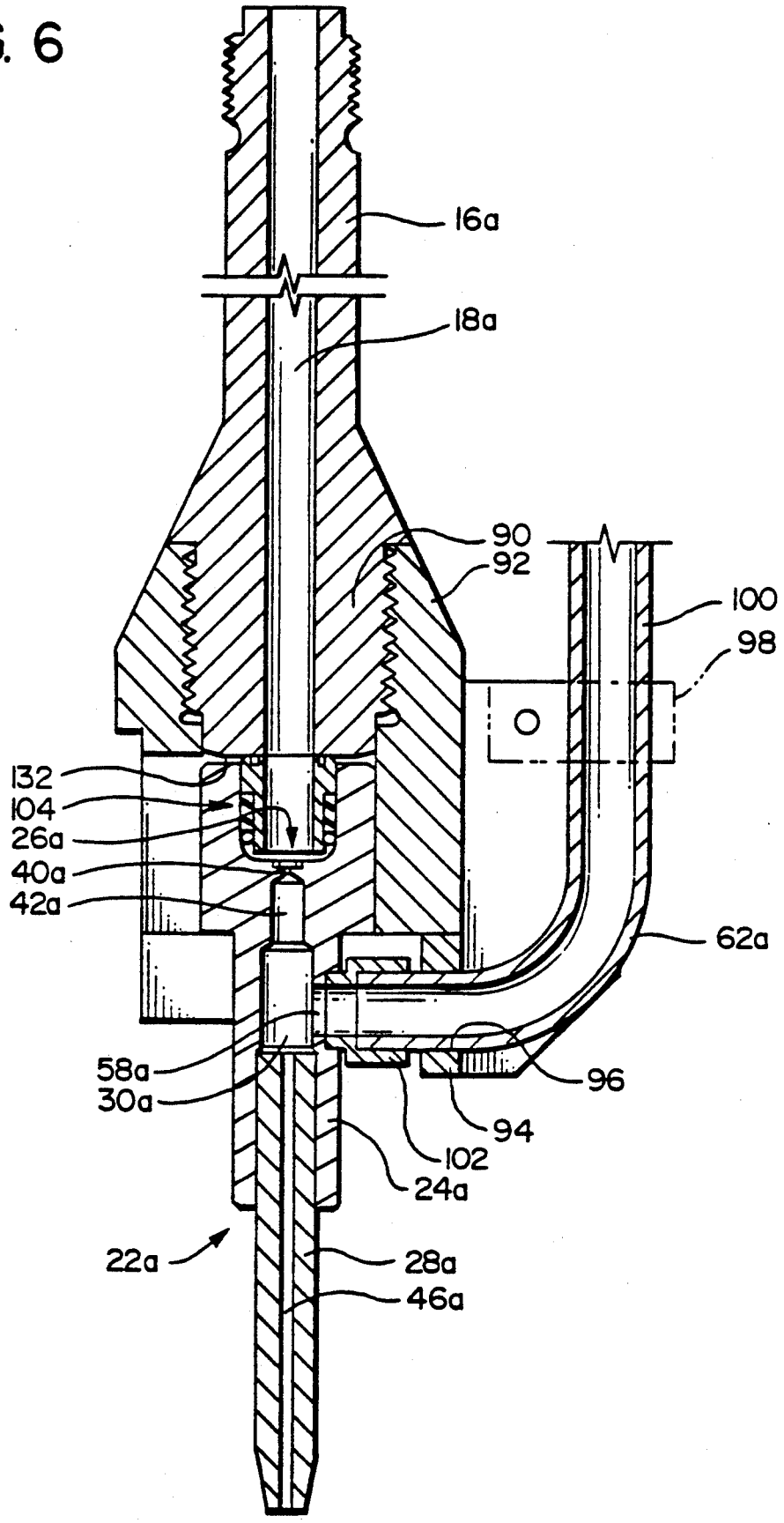
FIG. 6 is a longitudinal sectional view taken along the longitudinal centerline of the cartridge assembly, and further showing other components of the overall combination.

With reference to FIG. 3, there is shown a first embodiment of the cartridge assembly 22 of the present invention. This cartridge assembly comprises three main components, namely an integrally rigid cartridge housing 24, a nozzle unit 26 mounted at an upstream location of the cartridge housing 24, and a discharge tube 28 located at the downstream end of the cartridge housing 24. Further, the housing 24 defines a generally cylindrical main mixing chamber section 30 which is positioned intermediate the nozzle unit 26 and the discharge tube 28.

The nozzle unit 26 comprises a jewel orifice 32 which has an orifice or opening 34 through which high pressure water from the chamber 18 flows to provide the high velocity jet emitted from the orifice or opening 34. is made of a seal material such as UHMW ultra high molecular weight polyethylene. Other materials are delrin and nylon. Metalic rings made out of bronze canalso may be used, however they will require precise machining. Orifice mounting with adhesive has also been tested with good results. An "O" ring can also be used but the jewel in this case will not be rigidly held, but enough to work adequately. This ring 36 functions to rigidly fixedly locate the jewel orifice 32 in a precisely located position, with the orifice or opening 34 being precisely aligned so that the liquid jet is discharged within very close tolerances of a longitudinal center axis 38 of the cartridge assembly 22.

As indicated previously, the nozzle unit 26 is fixedly mounted to the cartridge housing 24 so that in normal use, this nozzle unit 26 would not need to be removed from the housing 24. The jewel orifice 32 and the mounting ring 36 are fixedly placed in a shallow cylindrical recess 39 formed at the upstream middle portion of the cartridge housing 24. The ring 36 and jewel 32 are mounted in this opening 39 as follows. The ring (or 0 ring) 36 is first placed in position in the recess 39, and the jewel 32 is pressed inside the ring. A chamber in the ring 36 will assist in pressing the jewel into the ring 36.

The housing 24 has an upstream passageway portion 40 of a relatively small diameter which is aligned with, and immediately adjacent to, the orifice or opening 34 so as to receive the liquid jet emitted therefrom. This passageway 40 leads into an upper cylindrical mixing chamber section 42 which in turn leads into the main mixing chamber section 30. It will be noted that the diameter of the cylindrical mixing chamber 30 is moderately larger than that of the upper mixing chamber section 42. This stepped arrangement of the two chamber sections 30 and 42 has been found to enhance the operation of this apparatus in that abrasive particles which flow into the mixing chamber section 30 are less inclined to become clogged in the upper mixing chamber 30 and 42, since this arrangement prevents the circulation of the abrasive particles in the upper part of the mixing chamber. This arrangement of the mixing chamber sections 30 and 42 is to be covered in a separate patent application assigned to the same assignee as the present invention, and this arrangement is disclosed herein so that there is a full disclosure of the best mode of the present invention.

The downstream end of the cartridge housing 24 is formed with a cylindrical bore 44 which is machined within very close tolerances in a manner so as to be accurately centered on the aforementioned center axis 38. The discharge tube 28 has its upstream end inserted snugly into the bore 44 and is retained therein with a suitable liquid adhesive, such as that which is sold under the trademark "LOC-TITE". This is done in a manner that the tube 28 is accurately positioned and aligned so as to be centered on the longitudinal center axis 38.

One method of fabricating the cartridge 22 will now be described. The jewel 32 is mounted in the opening 39 with no hole or orifice 34 yet drilled in the jewel 32. Then the tube 28 is cemented in place in the bore 44. Next, the jewel 32 is drilled while guiding the drill assembly relative to the longitudinal centerline tube 28. If necessary, subsequent to the drilling, the jewel can be removed from the opening 39 and finished.

A second alternative method would be that the jewel 32 would be rigidly mounted in the recess 39 in a conventional manner. Then the mixing tube 28 is aligned in the bore 44 by means of a low pressure water jet. More specifically, the water jet at a relative low pressure (e.g. 500 PSI) is emitted from the jewel 34, and the tube 28 is aligned with the water jet while the water jet is flowing. Then the mixing tube is cemented in place using a quick adhesive agent, (or screws if necessary). An alignment fixture which allows relative alignment of the tube 28 with the housing 24 can be used. Three small set screws may be used to line up the tube 28 before the quick set cement is used.

A third method is what might be termed a "statistical inspection method", where the jewel 32, the tube 28 and the housing 24 are assembled to the best practical tolerance levels. Then the assembled cartridge 22 is tested on a fixture (using a low pressure water jet or a laser) to check the proper alignment. Failed assemblies will be randomly reassembled, and again tested. Those failing will again be reassembled. In this manner, a relatively high percentage of the properly aligned cartridges 22 can be achieved, and the few ultimately remaining cartridges which are not properly aligned are simply rejected.

The discharge tube 28 is or may be, of itself, of conventional design. The tube 28 defines a discharge passageway 46 which receives the liquid jet flowing from the orifice or opening 34 and passing through the mixing chamber 30. The inlet to the passageway 46 is formed with a convergent frusto conical taper (indicated at 48) to facilitate the entry of the liquid jet along with the abrasive particles which become entrained therein.

In order to introduce abrasive particles into the mixing chamber 30, there is provided an abrasive feed housing 50 formed with a longitudinal cylindrical opening 52 so that this housing 50 can be slid onto the cartridge housing 24 which then fits within the opening 52. A pair of 0 ring seals 54 and 56 are mounted at spaced locations within the housing 50, adjacent to the cylindrical opening 52 so as to form a seal between the cartridge housing 24 and the housing 50.

The cartridge housing 24 is formed with a lateral opening 58 leading to the mixing chamber 30, with this opening 58 being aligned with a matching opening 60 formed in the housing 50. An abrasive particle feed tube 62 connects to the abrasive particle housing 50, and this is connected to the housing 50 by means of an interiorly threaded retaining nut 64 incorporating an 0 ring seal 66. Thus, abrasive particles flow through a passageway 68 provided by the feed line 62 to pass through the openings 60 and 58 and into the mixing chamber 30. The housing 50 is connected to the cartridge housing 24 by suitable means, one such means being simply a retaining screw 70 which threads into the side of the abrasive particle housing to engage the outside wall of the cartridge housing 24.

To mount the cartridge assembly 22 to the main housing 16, there is provided a connecting means in the form of an interiorly threaded mounting nut 72 which threadedly engages matching threads 74 on the lower exterior side portion of the main housing 16. The lower end of the nut 72 has a radially inwardly extending annular lip or flange 76 which engages a matching shoulder 78 of a radially outwardly extending annular lip or flange 80 formed integrally with the cartridge housing 24.

The cartridge housing 24 has an upstream cylindrical extension 82 of a reduced diameter (relative to the main portion of the cartridge housing 24) which fits within the downstream end of the chamber 18. Further, the upstream face 84 of the cartridge housing 24 surrounding the protrusion 82 forms a metal to metal seal with the downstream surface 86 of the main housing 16.

To describe the operation of the present invention, high pressure liquid (e.g. water which is pressurized to between 10,000 to 100,000 PSI or possibly higher) is directed from the inlet pipe 14 through the valve member 12 into the chamber 18 of the main housing 16. This water flows through the opening or orifice 34 of the jewel orifice 32 to be emitted as a high pressure liquid jet to pass first through the opening 42, thence into the upper mixing chamber section 42 and into the main mixing chamber section 30. At the same time, there is a flow of air carrying abrasive particles through the passageway 68 into the opening 62 and through the side opening 58 into the chamber portion 30. As is well known in the prior art, the liquid abrasive particles become entrained into the liquid jet to be carried through the passageway entry portion 48 and into the passageway 46, with the abrasive ladened jet passing out the lower end of the passageway 46.

Let it now be assumed that after a period of time, there is sufficient wear in the interior surface 88 of the tube 28 that defines the discharge passageway 46 so that the quality of the abrasive ladened jet begins to deteriorate. To replace the cartridge assembly 22, the retaining screw 70 is loosened and the abrasive particle housing 50 is slipped off the cartridge housing 24. Then the retaining nut 72 is unthreaded from the main housing 16 so that the cartridge assembly 22 is removed from the main housing 16. After that, a new cartridge assembly 22, (with the nozzle unit 26 and the discharge tube 28 already properly mounted, positioned and aligned in the cartridge housing 24) is mounted to the main housing 16 in the position shown in FIG. 3, and the retaining nut 72 is again threaded onto the main housing 16 to retain the cartridge assembly 22 in place. Then the particle abrasive housing 50 is slipped onto the cartridge housing 24 and retained in place by means of the retaining screw 70.

The cartridge assembly 22 which has been removed can then be shipped back to a factory location where useable components can be salvaged. With regard to the newly installed cartridge assembly 22, it can be appreciated that it is a relatively simply operation to remove the abrasive particle housing 50 and the retaining nut 72, insert the new cartridge 22 in place of the old cartridge 22, and replace the retaining nut 72 and the abrasive particle housing 50 in the assembled position as shown in FIG. 3.

It should be emphasized that the cartridge housing 24 is a unitary, integrally rigid member. Thus, when the nozzle unit 26 and the discharge tube 28 are carefully positioned and aligned in their respective positions in this housing 24, this precise positioning and alignment remains intact when the cartridge assembly 22 is placed in its operating position as shown in FIG. 3.

A second embodiment of the present invention is shown in FIGS. 4 through 8. Components of the second embodiment which are similar to components of the first embodiment will be given like numerical designations with an "a" suffix distinguishing those of the second embodiment.

The second embodiment **10*a* thus comprises a valve member 12*a*, a high pressure inlet line 14*a*, a main housing 16*a* and an air actuated control member 20*a* to control the valve member 12*a*. The cartridge assembly 22*a* of this second embodiment differs from the cartridge assembly 22 of the first embodiment in that the second cartridge assembly 22*a*, instead of being connected to its main housing 16*a* by means of a mounting nut being threaded on to the main housing 16**, is instead simply moved laterally into a slot-like opening into the operating position.

The cartridge assembly **22*a* comprises a cartridge housing 24, in which is mounted at its upstream end a nozzle unit 26*a*. A discharge tube 28*a* is mounted to the lower end of the cartridge housing 24*a*. The manner in which the cartridge assembly 22*a* is preassembled at a factory location is, relative to the nozzle unit 26*a* and the discharge tube 28*a*, substantially the same as with the first embodiment. Accordingly, no detailed description of this mode of assembly will be included herein. Likewise, as in the first embodiment, there is a main mixing chamber section 30*a* of a larger diameter, and also an upper mixing chamber portion 42*a* of a smaller diameter, with a relatively small diameter passageway 40*a* leading into the upper mixing chamber portion 42*a***.

The main housing **16*a* has a lower threaded end portion 90 on to which is threaded a mounting insert 92 which remains connected to the housing portion 90 during insertion of (and removal of) the cartridge assembly 22*a*. The components 90 and 92** are formed as two parts threadedly interconnecting one another primarily for convenience of manufacture.

The housing member 92 has a lower tab or extension 94 having a through opening 96 to receive an abrasive feed tube **62*a*. Also, the housing insert 92 has an upper lateral extension 98 to engage and position a further upstream portion 100 of the tube 62*a*. The outlet end of the tube 62*a* fits into a coupling 102 which in turn is removably connected to the cartridge housing 24*a* at the location of a lateral opening 58*a* in the cartridge housing 24*a***.

Figure 7:
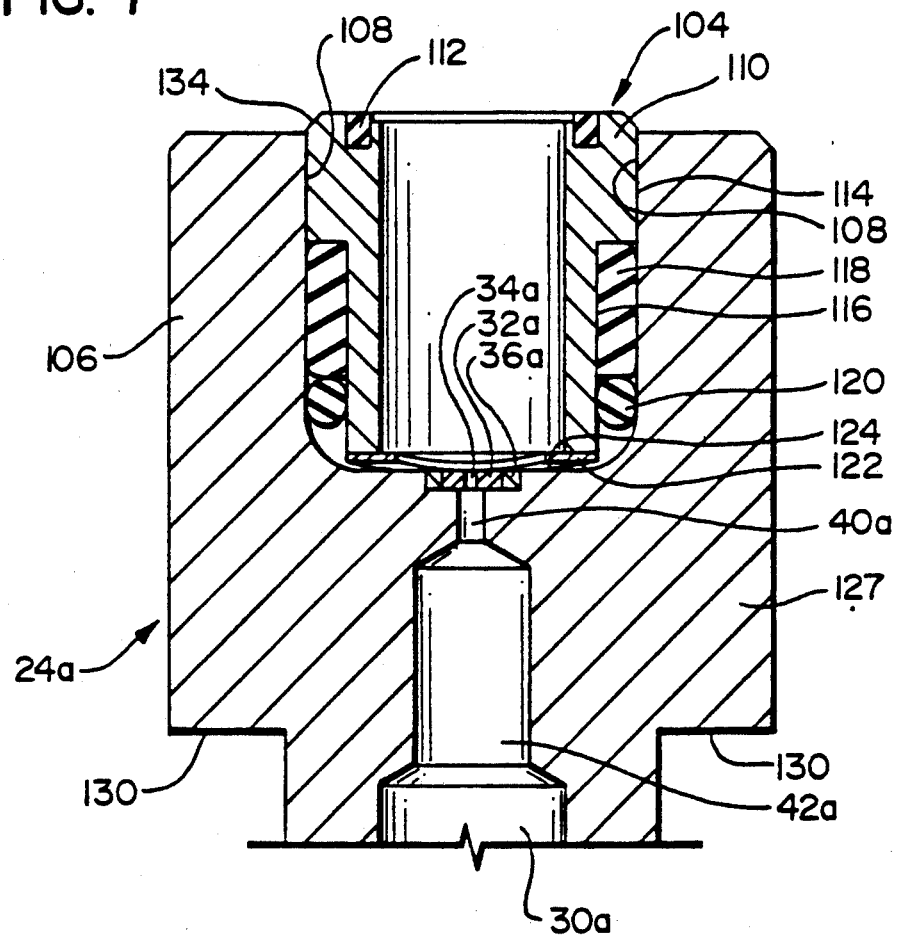
FIG. 7 is a further sectional view taken along the longitudinal centerline of the second embodiment, and showing in more detail a disconnecting seal member utilized in the second embodiment.
Figure 8:
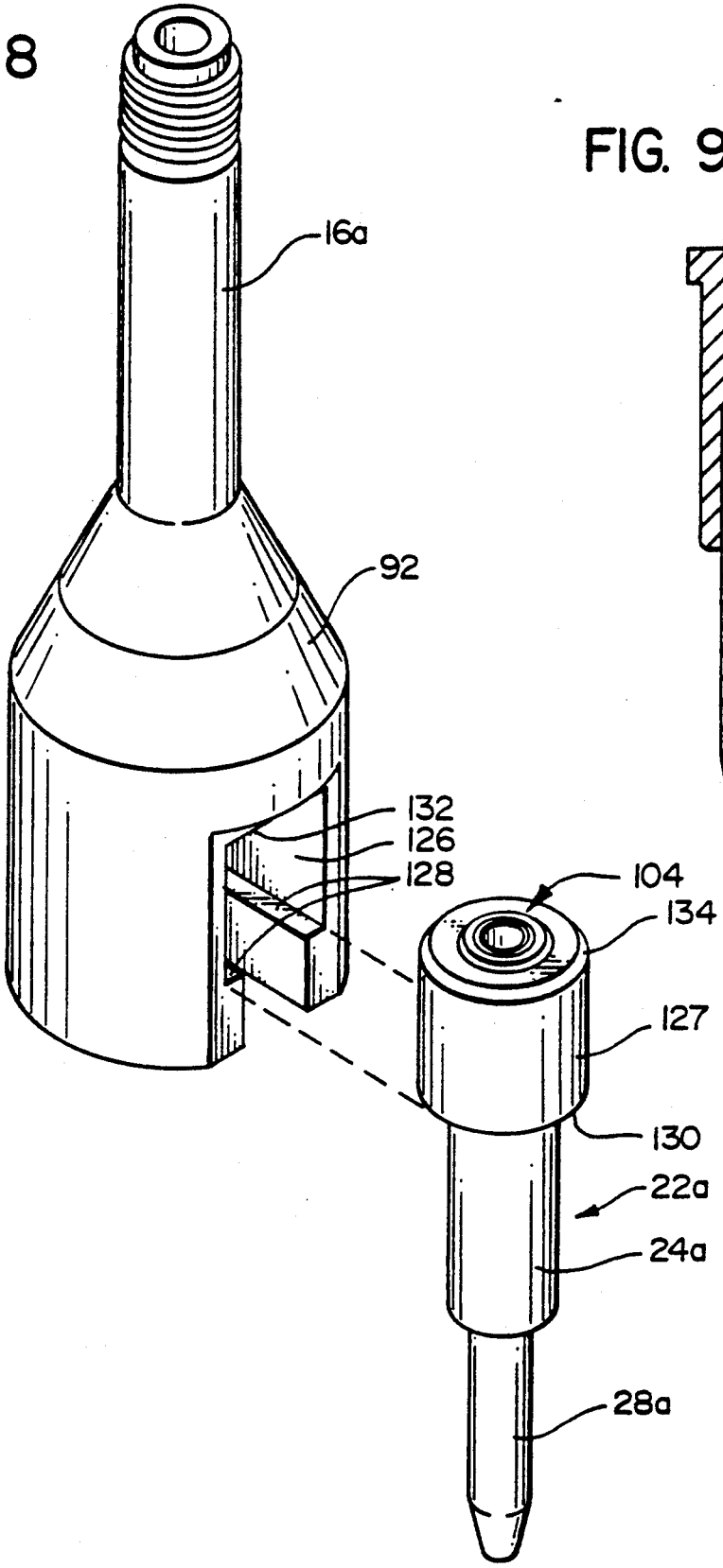
FIG. 8 is a view taken at line 8—8 and showing the recess in the amine housing to receive the cartridge.
Figure 9:
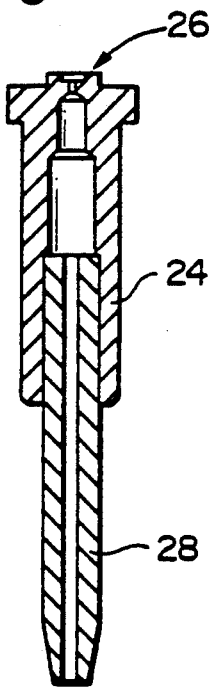
FIG. 9 is a longitudinal sectional view of the cartridge during the fabrication thereof.

The cartridge assembly of **22*a* of the second embodiment differs from the first embodiment 22 in that it is provided with a quick disconnect seal 104 positioned in the upper end off the cartridge housing 24*a*. More particularly, as shown in FIG. 7, the upper end of the cartridge housing 24*a* is formed with an upper cylindrical annular extension 106 which provides a cylindrical recess 108 to receive the aforementioned quick disconnect seal 104. This seal 104 comprises an annular metallic seal housing 110 having at its upper edge a recess to accommodate a circular O ring 112 made of a moderately yielding material. The outer cylindrical surface 114 of the upper portion of the seal housing 110 is dimensioned to fit closely against the interior surface defining the recess 108. The lower outer surface portion 116 of the seal housing 110 is stepped radially inwardly to provide an outer annular recess in which is positioned an upper cylindrical seal member 118 made of a relatively rigid material, and also to accommodate a lower O ring seal 120 made of a relatively more yielding material. A spring washer 122 is provided at the lower end of the seal housing 110 and is positioned against a lower surface 124 at the base of the recess 108. This spring washer 122** has along its peripheral length an undulating configuration so that it can be resiliently compressed.

The housing section 92 is provided with a laterally extending recess 126 (see FIG. 8) which is sized to receive an upper larger cylindrical portion 127 of the cartridge housing 24*a*. There is at the lower part of the recess 126 a pair of upwardly facing shoulders or surfaces 128 which are positioned on opposite sides of the recess 126 to engage portions of the lower annular peripheral surface 130 of the upper housing section 127. Thus, when the cartridge assembly 22*a* is placed in the recess 126, the cartridge surfaces 130 slide into the operating position along the surfaces 128. At the same time, the upper seal ring 112 of the seal housing 110 comes into engagement with a downwardly facing surface 132 of the main housing 16*a*, with the seal ring 112 bearing against this surface 132. The upper peripheral edge portion 134 of the seal housing 110 is chanphered to form a slanted surface to facilitate the insertion.

In operation, the nozzle assembly 26*a* and the tube 28*a* are assembled in substantially manner as described with reference to the first embodiment. Also, the components of the quick disconnect seal 104 are assembled. The cartridge assembly 22*a* can then be moved into the recess 126 of the main housing section 92 as described above, to the operating position where the seal housing 110 is in vertical alignment with the chamber 18*a*, and the O ring seal 112 extends around the lower end opening of the chamber 18*a*.

When pressurized fluid is fed into the chamber 18*a*, the O ring seal 112 initially forms a circumferential seal. As pressure in the chamber 18*a* increases, this pressure bears against the lower surface of the seal housing 110, and also against the seal member 120. This causes a seal to be formed at the location of the seal members 120 and 118. Further, this upward pressure against the housing 110 facilitates in forming a seal between the housing 110 and the surface 132 of the main housing 16*a*. (This disconnect seal 104 is described herein to ensure that the best mode of the invention is presented. This disconnect seal 104 is to be the subject matter of another U.S. Patent application which is to be subsequently filed.)

It is apparent that the cartridge assembly 22*a* can be preassembled at a factory location, and then inserted into (and removed from) the lower section 92 of the main housing 16*a*. Thus, when either the jewel orifice 32*a* or the discharge tube 28*a* deteriorate so that these are not operating properly, then the old assembly 22*a* can be returned to the factory location, and a new cartridge assembly 22*a* inserted into the operating position in the apparatus. Also it is to be understood that the disconnect seal 104 could be formed in a recess formed in the lower part of the main housing 16*a*.

It is apparent that various modifications could be made to the present invention without departing from the basic teachings thereof.

We claim:

1. A quick disconnect seal assembly having a longitudinal axis, said assembly comprising:

a. a fluid containing first member defining a fluid containing first region having a first interface area, said first member having a contact surface surrounding said fluid region at said first interface area;

b. A fluid containing second member having a side wall defining a seal and fluid containing second region and having a second interface area which, with said second member adjacent to said first member, is adjacent to and communicates with said first interface area;

c. an annular seal housing positioned in said second region adjacent to said side wall and having an annular interface seal surface located to be adjacent to the contact surface of the first member;

d. said seal housing having at said interface seal surface an annular first seal means to provide a low pressure seal at said interface seal surface between the contact surface of the first member and the interface seal surface of the seal housing;

said seal housing having a circumferential high pressure second seal means surrounding said seal housing at a location spaced from said interface seal surface so as to form a second seal between an annular outer surface of said seal housing and said side wall;

f. said seal housing having a fluid pressure surface generally transverse to said longitudinally axis and facing oppositely to said interface seal surface in a manner that fluid pressure in said second fluid region bears against said pressure surface to push said seal housing toward said contact surface of the first member, thus forming a seal around said interface areas, and with fluid in said second region being contained by said second seal.

2. The seal assembly as recited in claim 1, further comprising a spring washer means bearing against said seal housing to press said seal housing toward said first member.

3. The seal assembly as recited in claim 1, wherein said seal housing is formed with a circumferential recess spaced from said side wall, with said second seal means being formed in said recess.

4. The seal assembly as recited in claim 1, wherein said first member and said second member are configured at there respective inner face areas so as to permit relative movement of said first and second members transversely to said longitudinal axis, whereby one of said first and second members can be moved transversely into matching alignment with the other set of said first and second members to form a disconnect seal between said first and second members.

* * * * *